US007260860B2

(12) United States Patent
Chambers et al.

(10) Patent No.: US 7,260,860 B2
(45) Date of Patent: Aug. 28, 2007

(54) MATTRESS SYSTEM FOR A HOSPITAL BED

(75) Inventors: Kenith W. Chambers, Batesville, IN (US); Mary Butler, Charleston, SC (US); Suzanne Bish, Ft. Wright, KY (US)

(73) Assignee: Hill-Rom Services, Inc., Wilmington, DE (US)

( * ) Notice: Subject to any disclaimer, the term of this patent is extended or adjusted under 35 U.S.C. 154(b) by 166 days.

(21) Appl. No.: 11/073,795

(22) Filed: Mar. 7, 2005

(65) Prior Publication Data

US 2006/0026767 A1 Feb. 9, 2006

Related U.S. Application Data

(60) Provisional application No. 60/598,817, filed on Aug. 4, 2004, provisional application No. 60/598,714, filed on Aug. 4, 2004.

(51) Int. Cl.
*A61G 7/057* (2006.01)
*A47C 27/10* (2006.01)

(52) U.S. Cl. ..... 5/713; 5/715; 5/185

(58) Field of Classification Search ..... 5/706–715, 5/185

See application file for complete search history.

(56) References Cited

U.S. PATENT DOCUMENTS

| | | | | |
|---|---|---|---|---|
| 779,576 | A | 1/1905 | Berryman | |
| 1,576,211 | A | 3/1926 | O'Kane | |
| 2,253,801 | A | 8/1941 | Neal | |
| 3,303,518 | A | 2/1967 | Ingram | |
| 3,772,717 | A | 11/1973 | Yuen et al. | |
| 3,978,530 | A | 9/1976 | Amarantos | |
| 4,477,935 | A | 10/1984 | Griffin | |
| 4,483,029 | A | 11/1984 | Paul | |
| 4,525,885 | A | 7/1985 | Hunt et al. | |
| 4,527,298 | A | 7/1985 | Moulton | |
| 4,541,135 | A | 9/1985 | Karpov | |
| 4,542,547 | A * | 9/1985 | Sato | 5/713 |
| 4,637,083 | A | 1/1987 | Goodwin | |
| 4,638,519 | A | 1/1987 | Hess | |
| 4,669,136 | A * | 6/1987 | Waters et al. | 5/601 |
| 4,694,520 | A * | 9/1987 | Paul et al. | 5/706 |
| 4,825,486 | A | 5/1989 | Kimura et al. | |
| 4,944,060 | A | 7/1990 | Peery et al. | |
| 4,951,335 | A | 8/1990 | Eady | |

(Continued)

FOREIGN PATENT DOCUMENTS

| | | |
|---|---|---|
| GB | 159299 | 2/1921 |

(Continued)

OTHER PUBLICATIONS

"RemAir ABF Articulating Bariatric Frame"; 2 pages; http://www.mellenair.com/html/bariatric.html: copyright 1999.

(Continued)

*Primary Examiner*—Michael Trettel

(57) ABSTRACT

A mattress system for a hospital bed including a mattress and a control system. The mattress system may include a mattress including a core bladder, a width bladder and a vacuum device to apply a vacuum to the width bladder. The mattress is adapted to support a heavy or large patient, including a bariatric or obese patient.

48 Claims, 12 Drawing Sheets

U.S. PATENT DOCUMENTS

| | | | | |
|---|---|---|---|---|
| 4,993,920 | A | 2/1991 | Harkleroad et al. | |
| 5,020,176 | A | 6/1991 | Dotson | |
| 5,029,352 | A | 7/1991 | Hargest et al. | |
| 5,036,559 | A | 8/1991 | Hargest | |
| 5,067,189 | A | 11/1991 | Weedling et al. | |
| 5,083,332 | A | 1/1992 | Foster et al. | |
| 5,121,512 | A | 6/1992 | Kaufmann | |
| 5,129,115 | A * | 7/1992 | Higgins et al. | 5/713 |
| 5,168,589 | A | 12/1992 | Stroh et al. | |
| 5,249,319 | A | 10/1993 | Higgs | |
| 5,267,364 | A | 12/1993 | Volk | |
| 5,325,551 | A | 7/1994 | Tappel et al. | |
| 5,483,709 | A | 1/1996 | Foster et al. | |
| 5,539,942 | A | 7/1996 | Melou | |
| 5,542,136 | A | 8/1996 | Tappel | |
| 5,561,873 | A | 10/1996 | Weedling | |
| 5,564,142 | A | 10/1996 | Liu | |
| 5,586,346 | A | 12/1996 | Stacy et al. | |
| 5,611,096 | A * | 3/1997 | Bartlett et al. | 5/617 |
| 5,623,736 | A | 4/1997 | Soltani et al. | |
| 5,634,225 | A | 6/1997 | Miller, Sr. et al. | |
| 5,699,570 | A | 12/1997 | Wilkinson et al. | |
| 5,745,942 | A * | 5/1998 | Wilkerson | 5/715 |
| 5,787,531 | A | 8/1998 | Pepe | |
| 5,794,288 | A | 8/1998 | Soltani et al. | |
| 5,815,865 | A | 10/1998 | Washburn et al. | |
| 6,021,533 | A | 2/2000 | Ellis et al. | |
| 6,216,300 | B1 * | 4/2001 | Hannagan | 5/713 |
| 6,295,675 | B1 | 10/2001 | Ellis et al. | |
| 6,357,065 | B1 * | 3/2002 | Adams | 5/618 |
| 6,467,113 | B2 | 10/2002 | Ellis et al. | |
| 6,760,939 | B2 | 7/2004 | Ellis et al. | |
| 7,028,358 | B2 * | 4/2006 | Liu | 5/710 |
| 2004/0255386 | A1 | 12/2004 | Liu | |
| 2006/0101580 | A1 * | 5/2006 | Biggie et al. | 5/710 |

FOREIGN PATENT DOCUMENTS

| | | |
|---|---|---|
| GB | 298817 | 10/1928 |
| GB | 2 092 439 A | 8/1982 |
| GB | 2 199 803 A | 7/1988 |
| TW | 200500056 | 1/2005 |
| WO | WO94/09686 | 5/1994 |
| WO | WO95/31920 | 11/1995 |
| WO | WO96/33641 | 10/1996 |

OTHER PUBLICATIONS

LUMEX AkroTech 4000, Lumex, date unknown.
GAYMAR Sof-Care Plus © Companion™ System, Gaymar Industries, Inc., 1994.
Air Flow 5000 Mattress Replacement System, Atlantis Medical, Milltown, NJ, date unknown.
microAIR™ 1000, GSI Medical Systems, Carmel, NY, 1989.
Impression, Pressure Relief Therapy, KCI, date unknown.
Economic Relief, Bio Therapy® Plus, Sunrise Medical Bio Clinic, Ontario, CA, date unknown.
Rrenaissance™, Therapeutic Mattress Replacement System, Pegausus Airwave Inc., date unknown.
Apropos, CRS-8500, National Patient Care Systems, date unknown.
ASAP II Therapy System, DynaMedics Corporation, London, ON, Canada, Mar. 1995.
DFS® Homecare Advanced Dynamic Flotation System, HNE Healthcare, Manalapan, NJ, date unknown.
Tri-Flex II System, CareSelections by Hill-Rom, Bariatric Care, 2004.
First Step, Mattress Replacement System, KCI, San Antonio, TX, 1991.
PRO 2000 MRS, Pneu-Care Series, Cardio Systems, Dallas, TX, date unknown.
Bazooka, Innovative Medical System, Manchester, NH, 1995.

* cited by examiner

MATTRESS SYSTEM FOR A HOSPITAL BED

CROSS-REFERENCE TO RELATED APPLICATION

This application claims the benefit of U.S. Provisional Patent Application Ser. No. 60/598,817, filed Aug. 4, 2004, titled Mattress Assembly, to Chambers et al., and U.S. Provisional Patent Application Ser. No. 60/598,714, filed Aug. 4, 2004, titled "Method and Apparatus for Securing a Mattress" to Chambers, the disclosures of which are expressly incorporated by reference herein.

U.S. patent application Ser. No. 10/890,357, filed on Jul. 13, 2004, which is a continuation application of U.S. application Ser. No. 10/254,343, filed Sep. 25, 2002, now U.S. Pat. No. 6,760,939, which is a divisional application of U.S. application Ser. No. 09/946,886, filed on Sep. 5, 2001, now U.S. Pat. No. 6,467,113, which is a continuation application of U.S. application Ser. No. 09/465,872, filed on Dec. 16, 1999, now U.S. Pat. No. 6,295,675, which is a divisional application of U.S. application Ser. No. 08/917,145 filed on Aug. 25, 1997, now U.S. Pat. No. 6,021,533, are all expressly incorporated by reference herein.

U.S. patent application Ser. No. 60/490,467 entitled "Hospital Bed" , filed concurrently herewith, is expressly incorporated by reference.

BACKGROUND AND SUMMARY OF THE INVENTION

The present invention relates to a hospital bed, and more particularly to a hospital bed for a heavy or large patient, including a bariatric or obese patient. The present invention furthermore relates to at least one mattress assembly including an adjustable patient support surface for use on the hospital bed. An air mattress and a foam mattress are each provided having an adjustable width.

Bariatric beds typically include a larger than average heavy duty frame to support the patient size and weight. Mattresses for use on the frame must also adequately support the obese patient to prevent "bottoming out". "Bottoming out" describes the condition where a portion of the patient is not sufficiently supported to prevent contact with the support structure beneath the mattress. Bariatric patients confined to a bed for a long period of time may be susceptible to decubitus ulcers (bedsores) or to skin chafing which can lead to skin sores.

According to one embodiment of the present invention, a patient support includes a support deck, a mattress, including an identifying feature, supported by the support deck, and a controller, coupled to the mattress, including an input device to select the identifying feature.

According to another illustrative embodiment of the invention, a mattress assembly is configured to support a patient on a patient support frame and includes a core portion, and an inflatable width adjustment portion positioned between the core portion and a perimeter of the mattress assembly. The perimeter has a first width when the width adjustment portion is inflated and a second width when the width adjustment portion is deflated. The second width is less than the first width. The core portion defines a majority of the width and maintains a patient in a preferred position above the bed frame when the inflatable width adjustment portion is inflated and deflated. An air supply is in fluid communication with the inflatable width adjustment portion.

According to a further illustrative embodiment of the present invention, a mattress assembly is configured to support a patient on a patient support frame and includes a core portion having a first side edge and a second side edge. A first width adjustment portion includes at least one bladder coupled to the first side edge of the core portion, wherein the mattress assembly includes independently inflatable head, seat, and foot zones. A second width adjustment portion includes at least one bladder coupled to the second side edge of the core portion, wherein the mattress assembly includes independently inflatable head, seat, and foot zones.

According to another illustrative embodiment of the present invention, a mattress assembly configured to support a patient on a patient support frame includes a foam layer including a first side and a second side. A first width adjustment bladder is coupled to the first side, and a second width adjustment bladder is coupled to the second side. A fluid supply is coupled to the first width adjustment bladder and the second width adjustment bladder.

In a further illustrative embodiment of the present invention, a mattress assembly includes a core portion including a first side edge and a second side edge. A first width adjustment portion includes at least one bladder coupled to the first side edge of the core portion. A second width adjustment portion includes at least one bladder coupled to the second side edge of the core portion. A fluid supply is coupled to the first width adjustment portion and the second width adjustment portion. A controller is configured to control the supply of fluid to the core portion based upon the characteristics of the core portion. Illustratively, the fluid supply is in communication with the core portion when the controller determines that the core portion includes at least one bladder.

Additional features and advantages of the invention will become apparent to those skilled in the art upon consideration of the following detailed description of illustrated embodiments exemplifying the best mode of carrying out the invention as presently perceived.

BRIEF DESCRIPTION OF THE DRAWINGS

The detailed description particularly refers to the accompanying figures in which.

DETAILED DESCRIPTION OF THE DRAWINGS

The embodiments described below and shown in the figures are merely exemplary and are not intended to limit the invention to the precise forms disclosed. Instead, the embodiments were selected for description to enable one of ordinary skill in the art to practice the invention.

Figure 1:
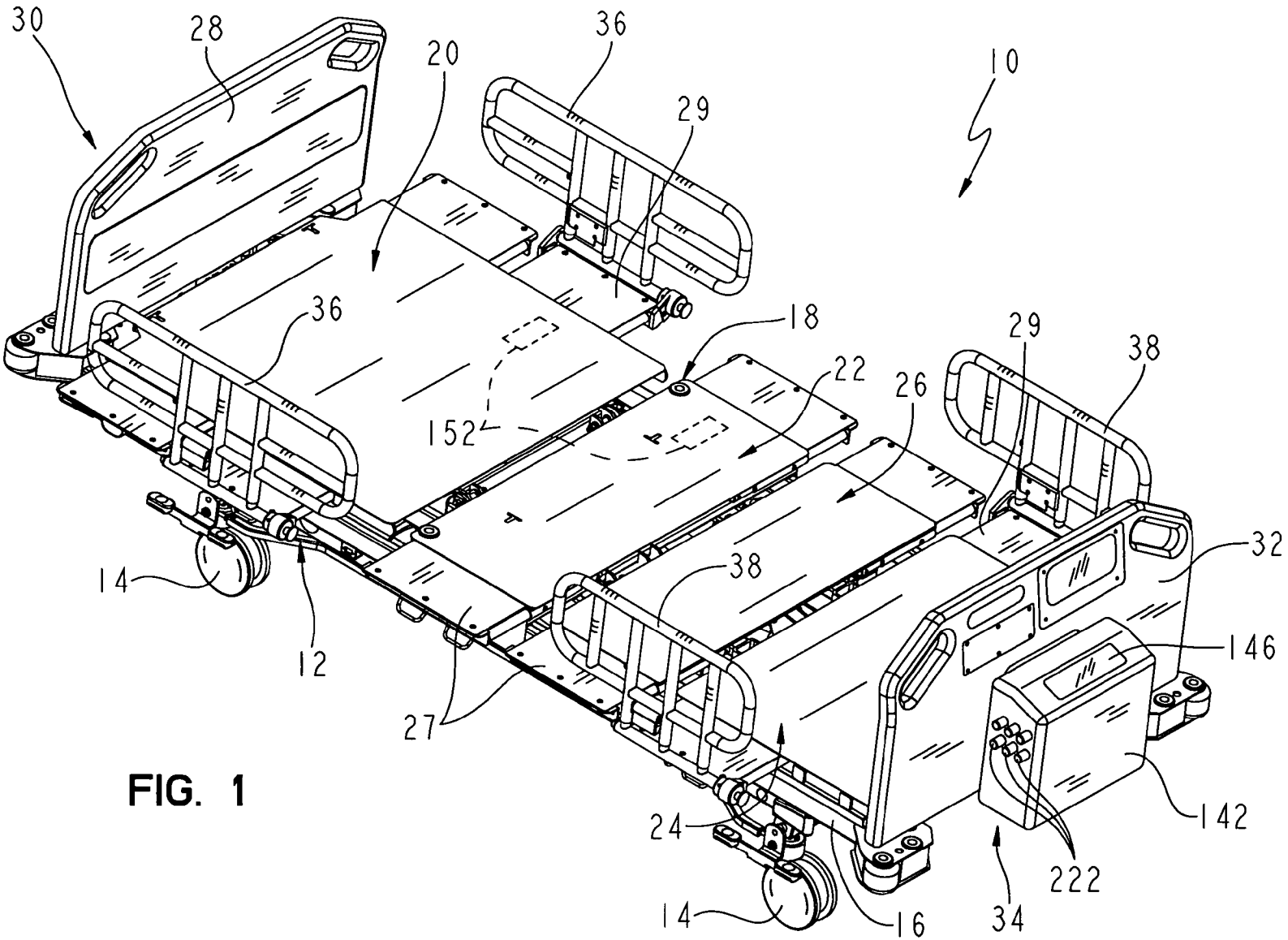
FIG. 1 is a perspective view of an illustrative embodiment patient support configured to receive a mattress assembly according to the present invention.

Referring initially to FIG. 1, a patient support 10 is illustrated as including a base frame 12 supported by a plurality of casters 14. An intermediate frame 16 is supported by the base frame 12 and is coupled to an articulating support deck 18. The support deck 18 is of conventional design and illustratively includes a plurality of sections configured to articulate relative to one another, including a head section 20 pivotally coupled to a seat section 22, and a foot section 24 pivotally coupled to the seat section 22. In the illustrative embodiment, a thigh section 26 is pivotally coupled intermediate the seat section 22 and the foot section 24. Further illustratively, the seat section 22 may be rigidly mounted to the intermediate frame 16 to prevent movement therebetween.

The support deck 18 includes sliding panels 27 and siderail sliding panels 29 which may be moved laterally, either manually or though an electrical control device, to expand and retract the width of the deck 18. Examples of expanding support decks are provided in U.S. patent application Ser. No. 60/591,838 entitled "Bariatric Bed", filed Jul. 28, 2004 and U.S. Pat. Nos. 6,212,714 and 6,357,065, the disclosures of which are expressly incorporated by reference herein.

A headboard 28 is mounted to the intermediate frame 16 adjacent a head end 30 of patient support 10, and a footboard 32 is mounted to the intermediate frame 16 adjacent a foot end 34 of patient support 10. The patient support 10 further includes a pair of head end siderails 36 and a pair of foot end siderails 38 coupled to the support deck 18 through the associated sliding panels 29 on opposite sides of the patient support 10. Details of the siderails are disclosed in U.S. patent application Ser. No. 60/659,221 entitled "Siderail for a Hospital Bed", filed concurrently herewith, the disclosure of which is expressly incorporated by reference herein.

Figure 2:
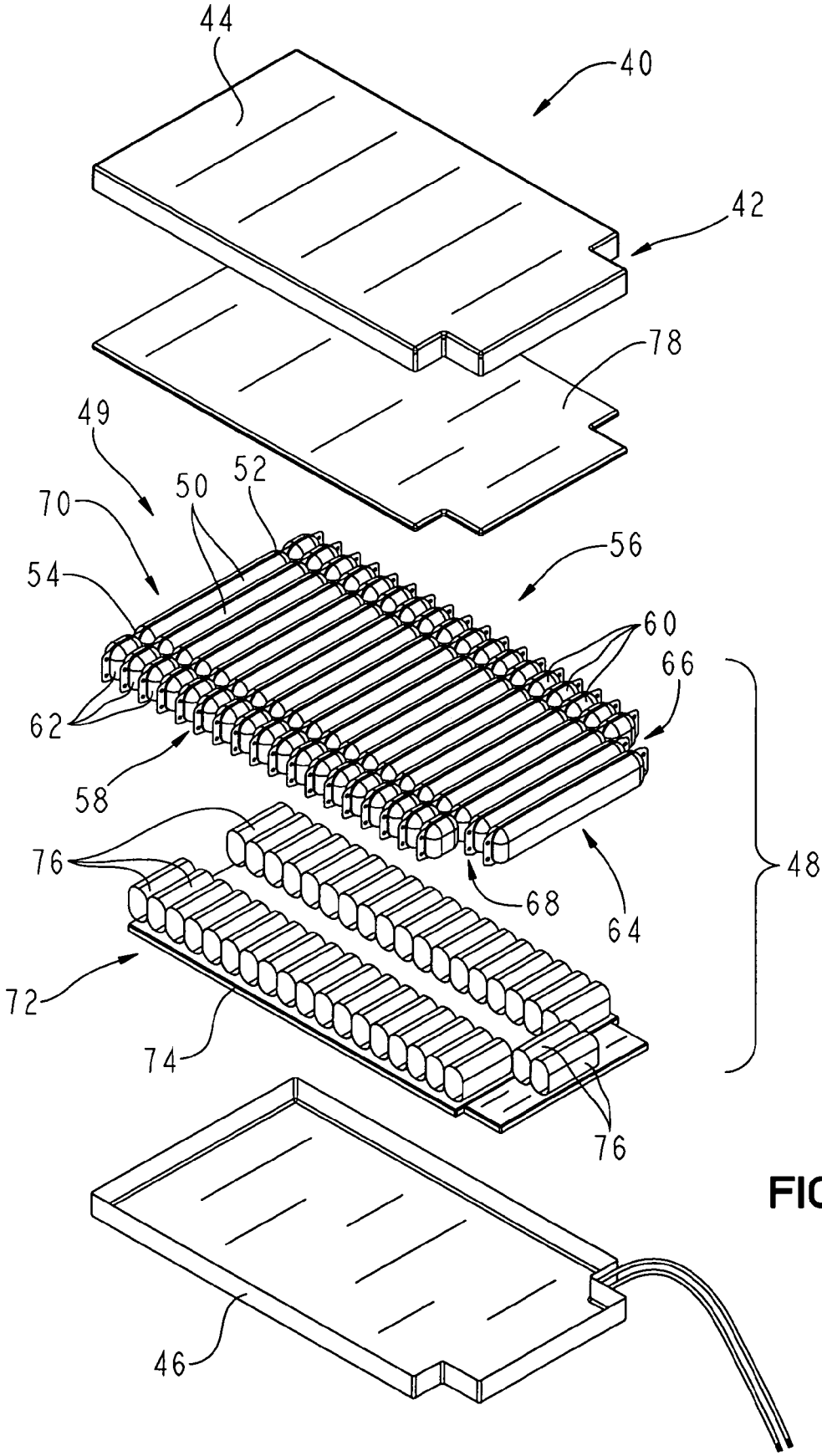
FIG. 2 is an exploded perspective view of an illustrative embodiment mattress assembly according to the present invention.

FIG. 2 illustrates a mattress assembly 40 according to an illustrative embodiment of the present invention. While the mattress assembly 40 is designed to accommodate bariatric or other patients of any weight of up to 1000 pounds, it is within the scope of the present invention to accommodate patients of greater than 1000 pounds. As detailed below, the mattress assembly 40 includes a perimeter having an adjustable width. Mattress assembly 40 includes an outer cover 42 including a top cover portion 44 and a bottom cover portion 46 configured to encapsulate an inner core assembly 48. Both the top cover portion 44 and the bottom cover portion 46 of the outer cover 42 are illustratively formed from a ticking material, such as a urethane coated nylon which is resistant to fluids and chemical stains and which may be washable.

Mattress restraints (not shown) are illustratively coupled to the bottom cover portion 46 and are configured to secure the mattress assembly 40 to the support deck 18. Details of the mattress restraints are disclosed in entitled U.S. Provisional Patent Application Ser. No. 60/598,714, titled "Method and Apparatus for Securing a Mattress", the disclosure of which is expressly incorporated by reference herein.

The inner core assembly 48 includes a core portion 49, illustratively a plurality of transversely extending air cushions or bladders 50 defining first and second sides 52 and 54, respectively. A first width adjustment portion 56 is coupled to the first side 52, and a second width adjustment portion 58 is coupled to the second side 54. Each of the first and second width adjustment portions 56 and 58 include a plurality of first and second width extension bladders 60 and 62, respectively. The width extension bladders 60 and 62 in the illustrative embodiment are configured to extend the mattress by approximately 5 inches on either side and include a depth of approximately 8 inches. Consequently, the bladders 60 and 62 may provide support to the patient.

In the illustrative embodiment of FIG. 2, the width extension bladders 60 and 62 do not extend to the foot end 64 of the core portion 49. More particularly, the last two width extension bladders 60 and 62 are missing thereby defining first and second side relief portions 66 and 68. The relief portions 66 and 68 provide user access below the mattress assembly 40 while providing an area for patient heel pressure relief. It is within the scope of the present invention to include the last two width extension bladder 60 and 62, such that relief portions 66 and 68 are not present. The core portion 49 also includes a head end 70.

With reference to FIG. 2, the bladders 50, 60, and 62 are all retained in position by a retainer assembly 72. The retainer assembly 72 includes a base 74 upon which a plurality of loops or tubes 76 are secured. The various bladders 50, 60, and 62 are slidably received within the tubes 76 and thereby retained in relative positions. Illustratively, the tubes 76 comprise a urethane film.

A vapor barrier 78 is positioned above the plurality of bladders 50, 60, and 62. The vapor barrier 78 is of conventional design and is configured to prevent soiling of the inner core assembly 48. Illustratively, the vapor barrier 78 may comprise a polyurethane coated material with a nylon substrate.

Figure 3:
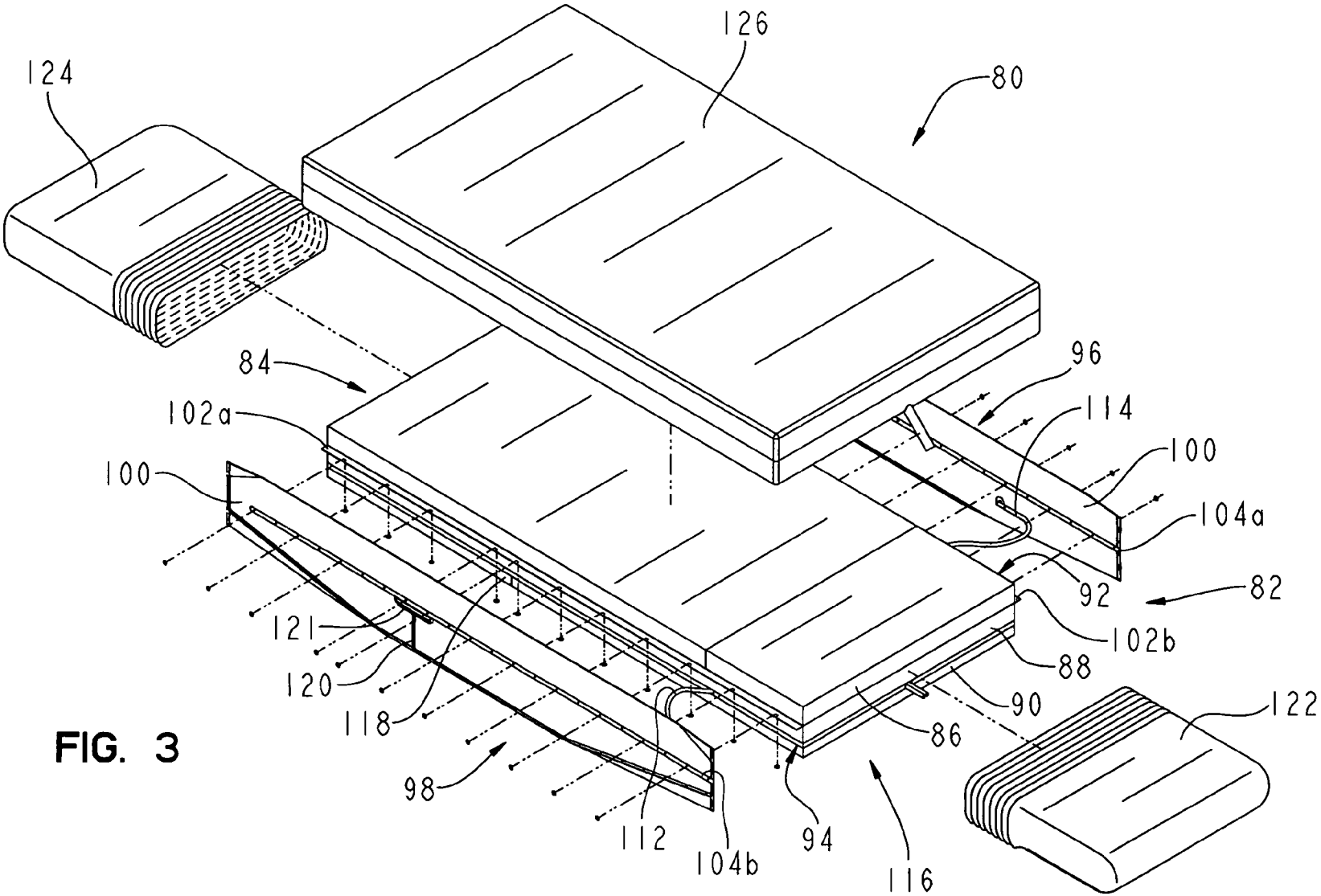
FIG. 3 is an exploded perspective view of a further illustrative embodiment mattress assembly according to the present invention.
Figure 4:
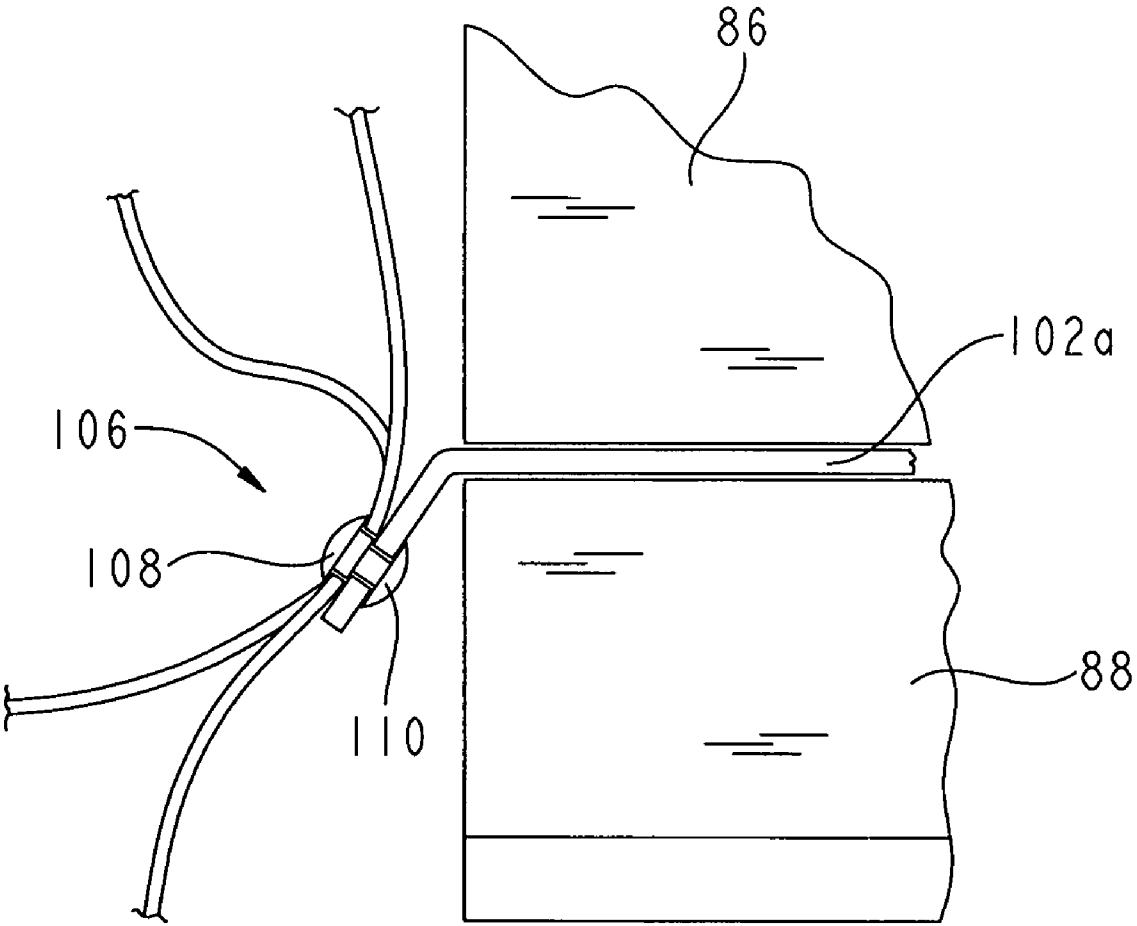
FIG. 4 is a partial end cut-away elevational view of the mattress assembly of FIG. 3.
Figure 5:
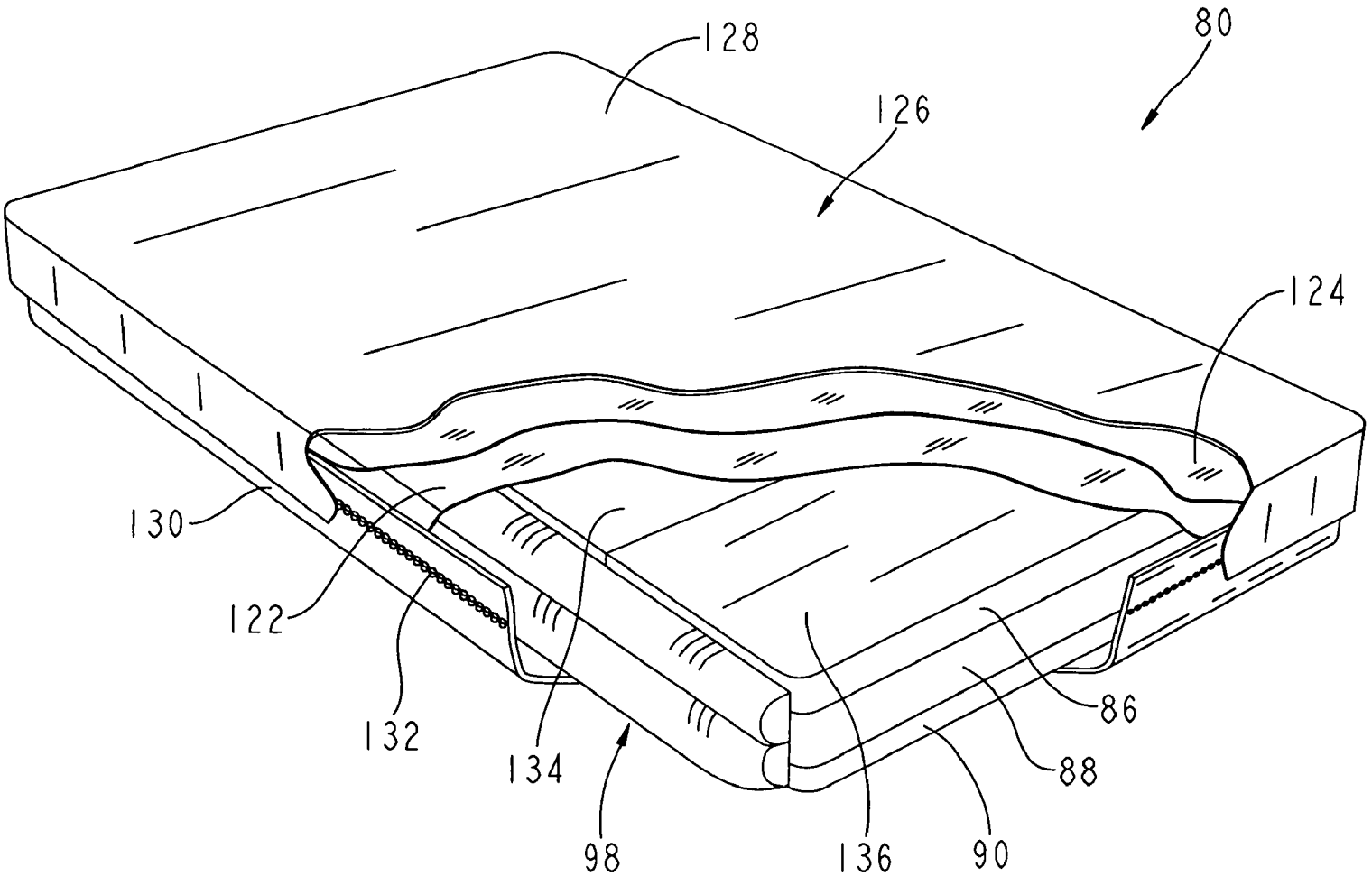
FIG. 5 is a perspective view, with a partial cut-away, of the mattress assembly of FIG. 3.

Referring now to FIGS. 3-5, a further illustrative embodiment mattress assembly 80 according to the present invention includes an inner core assembly 82 having a core portion 84, illustratively formed by a plurality of foam layers 86, 88, 90. It is within the scope of the present invention to have a single foam layer as well as more than one foam layer. The mattress assembly 80 generally accommodates bariatric or other patients of up to 1,000 pounds, although it is within the scope of the present invention to accommodate patients of greater weights. The core portion 84 includes a first side 92 and a second side 94 wherein a first width adjustment portion 96 is coupled to the first side 92 and a second width adjustment portion 98 is coupled to the second side 94. The first width adjustment portion 96 and second width adjustment portion 98 may provide support to the patient. Illustratively, both the first width adjustment portion 96 and the second width adjustment portion 98 comprise an inflatable bladder 100. The bladder 100 may form a substantially cylindrical shape when inflated. Alternatively, the bladder 100 may receive a web (not shown) configured to pull in the opposing sides of the bladder 100 upon inflation to make it taller and narrower. It is also envisioned that the bladder 100 may take the form of a bellows including a plurality of folds (not shown) which are collapsible into a substantially flat condition when the bladder 100 is deflated. Furthermore, the bladders 100 may include a length less than the mattress assembly 80 and positioned such that relief portions are provided, similar to the relief portions 66 and 68 previously described.

Connecting webs 102*a* and 102*b* extend outwardly from the first and second sides 92 and 94 of the core portion 84 and are configured to be secured to mating webs 104*a* and 104*b* extending inwardly from the respective width adjustment bladders 100. As shown in FIG. 4, the connecting web 102*a* may be positioned intermediate foam layers 86 and 88 and secured thereto by conventional means, such as adhesive or double sided tape. In the illustrative embodiment, a plurality of nylon snap rivets 106, each having a female portion 108 and cooperating male portion 110, are utilized to couple the webs 102 and 104 together. Each width adjustment bladder 100 is in fluid communication with a fluid supply through tubes 112 and 114. Tubes 112 and 114 illustratively pass between vertically adjacent foam layers 88 and 90 to the longitudinal center of a foot end 116 of mattress assembly 80. Such routing of tubes 112 and 114 prevents contact therewith by the patient while simultaneously providing hose management and kink prevention.

The foam layers 86, 88, and 90 of the core portion 84 include a laterally extending slit 118 defining a hinge to assist in bending of the mattress assembly 80 during articulation of the support deck 18. Similarly, each width adjustment bladder 100 includes a slit 120 positioned longitudinally adjacent the slit 118 to define a hinge point. A tube 121 may be positioned within each bladder 100 at the hinge point to prevent the air flow path from being sealed when the mattress assembly 80 is bent.

The core portion 84 and width adjustment portions 96 and 98 are received within a fire barrier 122 of conventional design. Illustratively, the fire barrier 122 comprises a fire-resistant mesh material, such as a fiberglass knit. Similarly, a shear liner 124 is received over the fire barrier 122. The shear liner 124 is illustratively formed of a polyurethane material. An outer cover 126, substantially the same as that detailed above, is received over the inner core assembly 82, fire barrier 122, and shear liner 124.

FIG. 5 further illustrates the mattress assembly 80 of FIG. 3 with a partial cutaway view. The outer cover 126 includes a first cover section 128 and a second cover section 130. Each of the cover sections 128 and 130 are mated together with an ultrasonic weld or sealing type of attachment 132. The foam layer 86 includes a body portion 134 and a heel portion 136. The indentation load deflection (ILD) of the body portion and the heel portion may be selected to achieve desired properties of pressure relief. For instance, the ILD of the heel portion 136 can be selected to provide for desired heel pressure relief to prevent pressure sores of the heel region.

Figure 6:
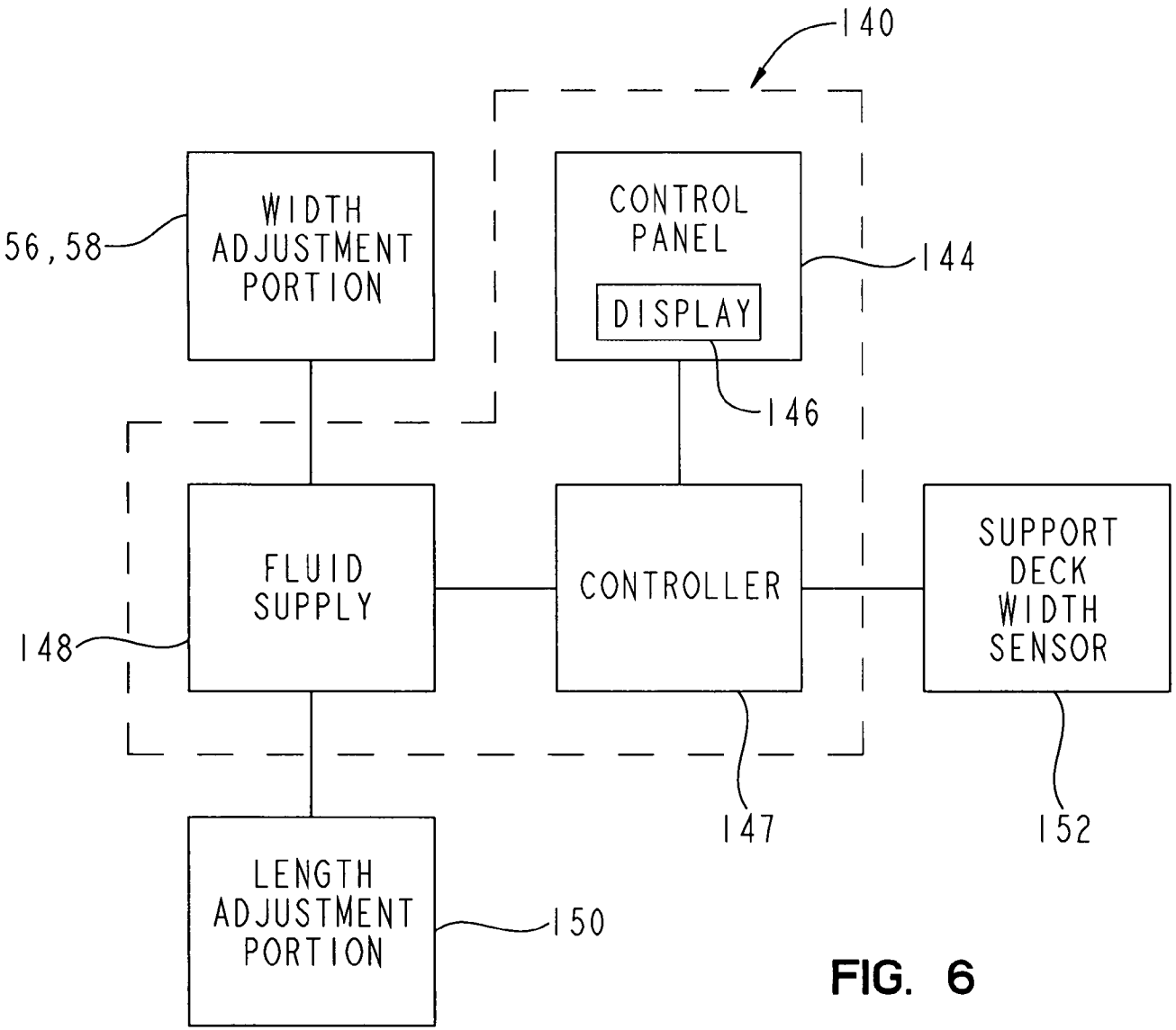
FIG. 6 is a block diagram illustrating communication with the control system of the present invention.

FIG. 6 illustrates a block diagram of a control system 140 for controlling the supply of fluid or air to either of the mattress options, the mattress 40 or the mattress 80, as well as for controlling certain features of the base frame 12. The control system 140 is housed within a control box 142 (see FIG. 1) which is coupled to the foot board 32 through a mounting apparatus. Details of the mounting apparatus are disclosed in U.S. patent application entitled "Footboard for a Hospital Bed" (Attorney Docket No. 8266-1336) filed concurrently herewith, the disclosure of which is expressly incorporated by reference herein.

The control box 142 includes a control panel 144 having a display 146 and an input device associated with the display for inputting or selecting a variety of features to be described herein. The control system 140 further includes a controller 147, which may include a microprocessor and associated memory, is configured not only to receive and to send signals or instructions to the control panel 144 but also to vary control of a fluid supply 148. The controller includes control algorithms to accommodate both the foam and air mattress. The amount of fluid supplied by the fluid supply 148, to either the bladders 50, width adjustment portions 56 and 58 or width adjustment portions 96, 98 is determined according to signals generated by the controller 147. These signals are generated in response to control software, including executable instructions, which is incorporated into the controller 147, as well as in response to inputs received through the control panel 144.

The fluid supply 148, in response to signals received from the controller 147, supplies fluid to the first width adjustment portion 56 and the second width adjustment portion 58. The fluid supply 148 also supplies fluid to a length adjustment portion 150. The fluid supply 148 is also coupled to the bladders 50 to be described with respect to FIG. 7. The controller 147 also generates signals which may control the width of the frame through the adjustment of the sliding panels 27 in response to an input received from the control panel 144. A plurality of support deck width sensors 152 are located on the deck to sense the location of the panels 27 which can be moved through the use of an actuating device, such as motors, as would be understood by one skilled in the art. The controller may be configured to cause the fluid supply to inflate the width adjustment bladder when the sensor detects the extended positions of the sliding panels.

Figure 7A:
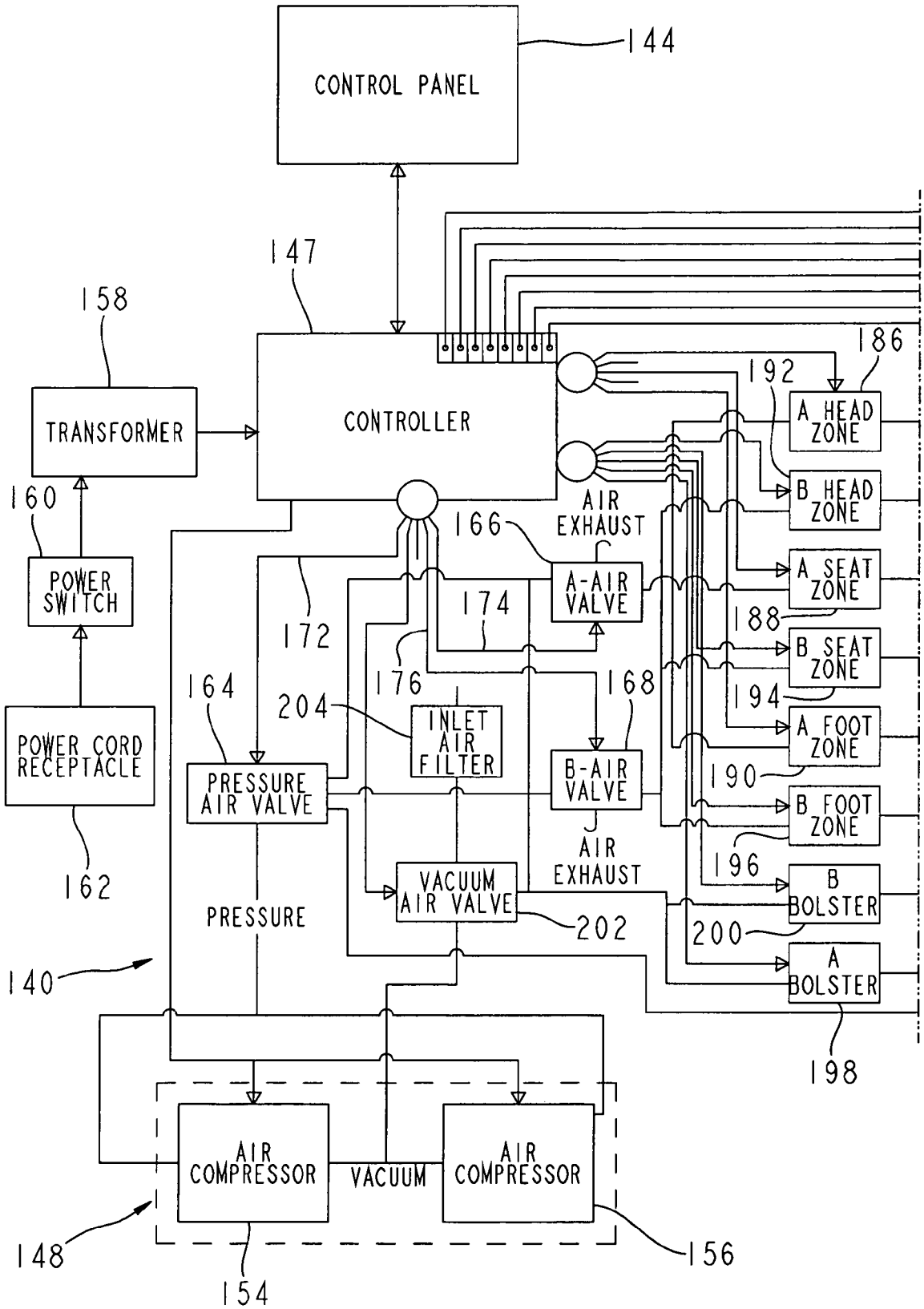
FIGS. 7A and 7B are a simplified schematic diagram of the control system and the mattress assembly of the present invention.
Figure 7B:
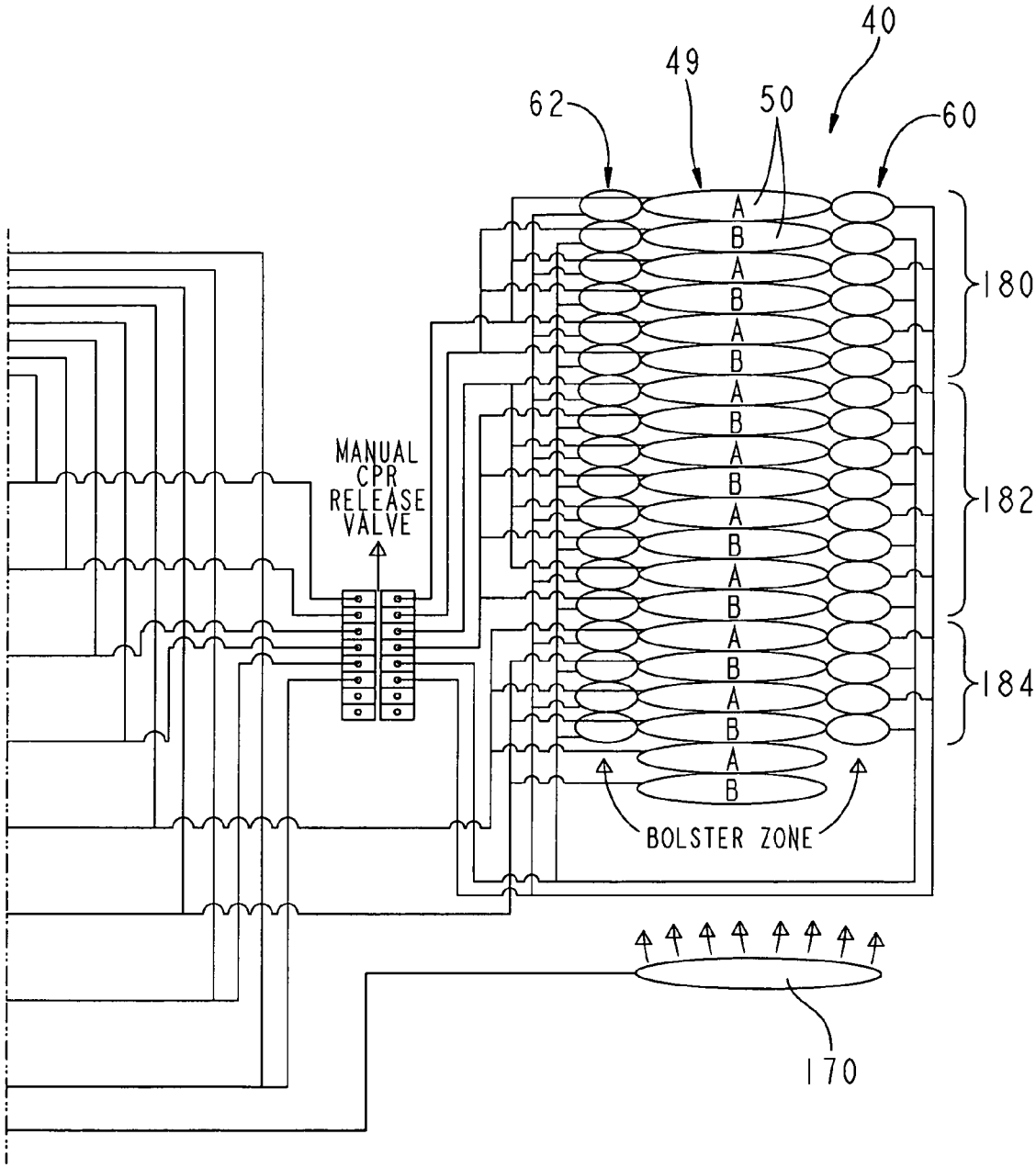

FIGS. 7A and 7B illustrate the connection of the control system 140 (FIG. 7A) to the mattress assembly 40 (FIG. 7B). As previously described in FIG. 6, the control panel 144 is coupled to the controller 147. The fluid supply 148 includes a first air compressor 154 and a second air compressor 156 which may be connected in parallel. While two compressors are shown to provide for a faster filling of the mattress assembly 40, a single air compressor could also be used. The controller 147 is also coupled to a transformer 158 which is controlled by a power switch 160 which receives power from a power cord 162.

The first compressor 154 and second compressor 156 generate air pressure which is controlled by a pressure air valve 164 coupled thereto. The pressure air valve 164 divides the air flow into three paths and is coupled to an A-air valve 166, a B-air valve 168, and a low air loss topper 170 illustrated in FIG. 7B. The controller 147 controls the amount of air pressure moving through respective air lines according to signals controlling flow through control line 172 for the pressure air valve 164, control line 174 for the air valve 166 and control line 176 for the B-air valve 168. These valves, as well as other valves coupled to a control line, as described herein, are typically solenoid operated control valves.

Referring now to FIG. 7B, each of the bladders 50 may be designated as an A bladder and a B bladder. The A bladders and the B bladders may be inflated simultaneously to create a uniformly inflated mattress. The A bladders and B bladders may also be inflated alternately in a variety of different sequences to provide an alternating pressure mattress.

The inner core assembly 49 includes a head section or zone 180, a seat section or zone 182, and a foot section or zone 184. Each of the zones is individually controlled by the controller 147 of FIG. 7A such that the pressure within the A bladders and B bladders are separately adjustable as a group as well as individually within each zone. For instance, the A-air valve 166 is coupled to the A bladders of the head zone 180 through the A head zone valve 186, the A seat zone valve 188 and the A foot zone valve 190. Likewise, the B-air valve 168 is coupled to the B bladders of the head zone 180 through B head zone valve 192. The B bladders of the seat section 182 are coupled through the B air valve 168 through the B seat zone valve 194. The B bladders of the foot section or zone 184 are coupled to the B-air valve 168 through the B foot zone valve 196. Each of the valves for the A and B bladders 186, 188, 190, 192, 194, and 196, selectively deliver air to the respective bladders under control of the controller 147 through the control lines as shown.

The valves described herein are known as on-off valves which may be in an open or closed position. The related instructions utilized by the controller may be appropriately designed to take into account the characteristics of the on-off valves. It is within the scope of the present invention to use other types of valves, such as proportional control valves, where the size of the opening is adjustable. When such valves are used, the controller instructions may be appropriately determined.

As can be seen in FIGS. 7A and 7B, the first width extension bladder 60 and second width extension bladder 62 are also each comprised of A and B bladders. The width extension bladders are also known as bolsters or bolster bladders within the art. The A bolster bladders of either the first or second extensions 60 and 62 are coupled to the A-air valve 166 through the A bolster valve 198. The B bladders of each of the width extensions 60 and 62 are controlled by the B bolster valve 200 which is coupled to the B-air valve 168. Each of these valves 198 and 200 are also coupled to control lines connected to the controller 147. It is within the scope of the present invention to have a single bladder for each of the first width extension bladder 60 and second width extension bladder 62. In this instance, a single valve may be coupled to both of the bladders 60 and 62 to control inflation at the same time or one valve may be coupled to the bladder 60 and one valve may be coupled to the bladder 62.

The control system 140 may apply a vacuum to certain selected bladders of the mattress assembly 40 and to the mattress assembly 80. For instance, when the foam mattress assembly 80 is coupled to the control system, the control lines from the controller 147 coupled to the valve 198, the valve 200, and to the topper 170 would be utilized. The remaining control lines to the remaining valves utilized for the head, seat, and foot zones of the air mattress, are not utilized since the foam mattress does not include bladders in these zones. Likewise, when the air mattress assembly 40 is coupled to the control system, the controller 147 may utilize each of the control lines coupling the controller to the various bladders of the mattress assembly 40. Additional details of this control scheme is described later herein.

To apply a vacuum to the selected bladders, the control system 140 includes a vacuum air valve 202 coupled to the air compressor 154 and the air compressor 156, the operating direction of which is reversed to create a vacuum. An inlet air filter 204 provides the necessary air inlet for creating the vacuum through the vacuum air valve 202.

Figure 8:
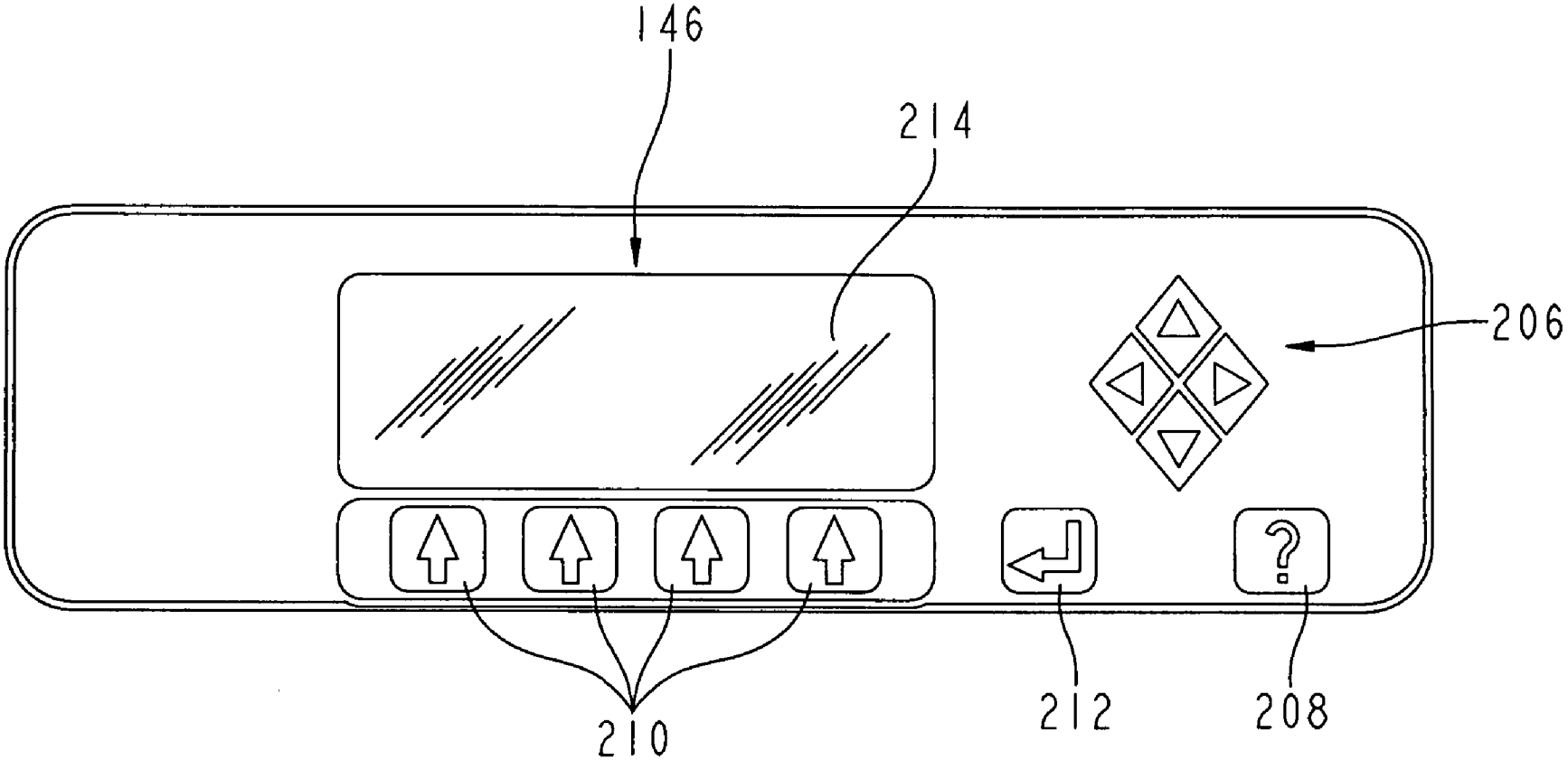
FIG. 8 is a plan view of the display of the present invention.

FIG. 8 illustrates the display 147 located on the control box 142. The display 146 or patient set-up screen, includes a plurality of user accessible input devices, such as buttons or a keypad, to select the various modes or operations of the present device. These buttons are typically selected manually by a user. Other input devices are also possible and include touch screens, voice recognition devices, infrared receivers receiving infrared signals from a remote transmitter, a processor sensing pressure, or wireless fidelity (Wi-Fi) devices. Handheld remotes are also possible. Buttons include up, down, left and right arrows 206 which are used to select settings on the display 146. A help button 208 when selected brings a help screen to the display 146.

A plurality of buttons 210 are used to select various functions or options when displayed on the display 146 as described later. Indicia or displayed markings indicate the selected function or option. The function or option shown by appropriate indicia is displayed on the display while an adjacent button may be depressed to select the appropriate function or option to which the button points. Once selections are made by the buttons 210, an enter button 212 is used to enter the selected options into the controller 147 for effecting the desired result. The display 146 includes a digital LCD screen 214 which displays a variety of features, functions, and options which are selected by the buttons described. In addition, the display 214 provides a real time display of air pressure for the head section 180, the seat section 182 and the foot section 184 if desired.

Figure 9:
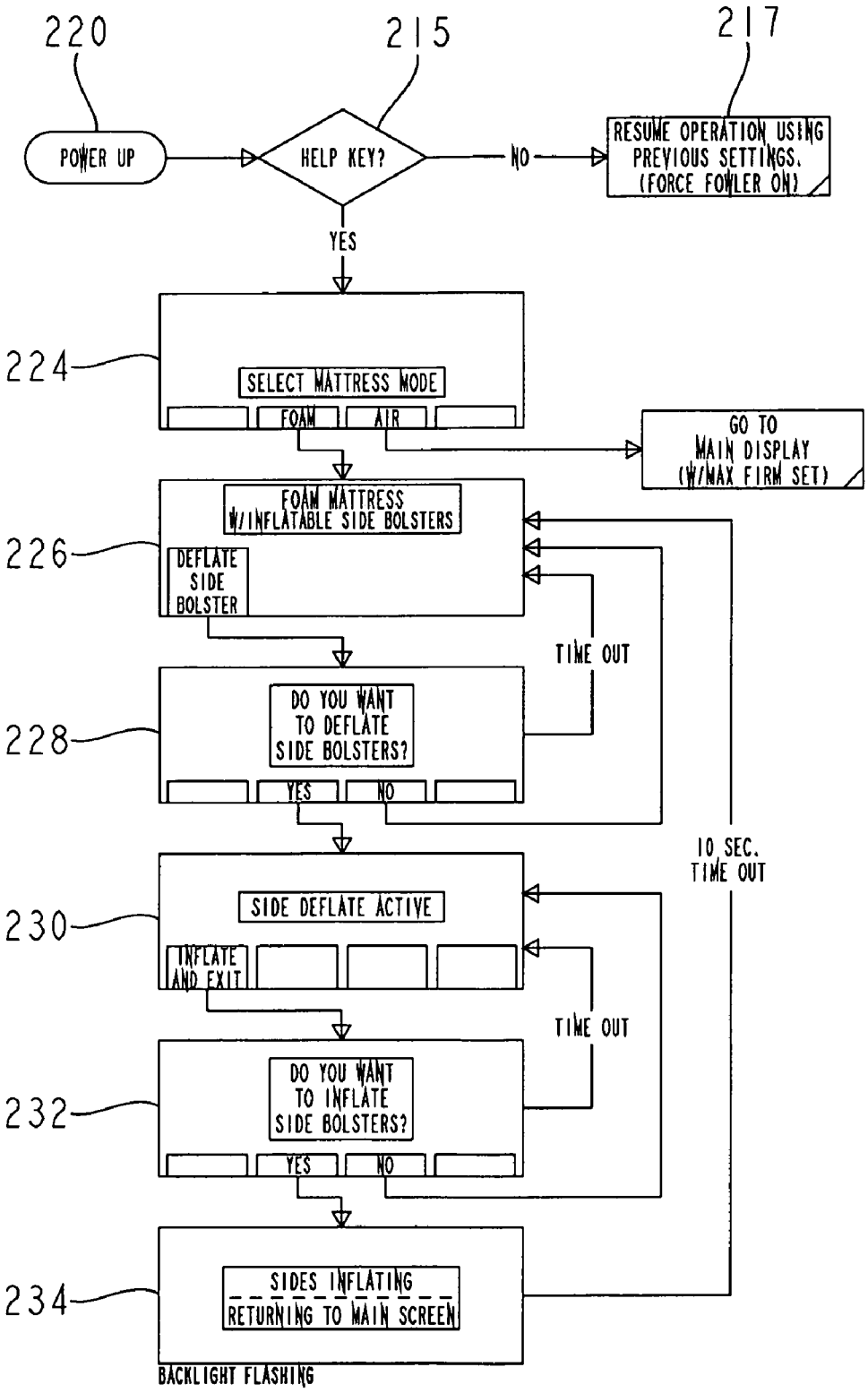
FIG. 9 is a flowchart illustrating a method of selecting the type of mattress assembly and a method of operating the mattress assembly of FIG. 3.

The controller 147, receiving various input signals from the control panel 144, maybe configured to provide various control signals responsive thereto to control the fluid supply 148 as previously discussed. As shown in FIG. 9, upon powering up of the control system 140 through selection of a power up button at block 220, the controller 147 examines the input device or control panel 144 to determine whether the help button or key 208 has been selected at decision block 215. If the help key 208 has not been selected, then operation of the entire mattress system simply defaults to its previous settings at block 217. If, however, the help key 208 has been selected, the display 146 prompts the user, through display of the appropriate screen, to select the type of mattress, either a foam mattress or an air mattress at block 224. Depending upon the type of mattress selected, the controller 147 generates control signals appropriate to either control inflation of the mattress assembly 40 including bladders 50 and first and second width extension bladders 52 and 54, or the inflation of first width adjustment portion 96, and the second width adjustment portion 98 of mattress assembly 80. For example, the controller 147 would select the A bolster valve 198 and the B bolster valve 200 in the case of a foam mattress through the appropriate control lines as illustrated but would not select each of the A and B head, seat, and foot zone valves.

The user, which may include a service technician or a caregiver, would select either the foam or air option depending on which type of mattress is placed on the base frame 12. Each mattress type includes an identifying feature which distinguishes one type of mattress from another. Without the cover, foam mattresses may be visually identified by the foam inner core and air mattresses identified by the air bladder inner core. Since both mattress types are typically enclosed by a cover, the mattress type may also be identified by a label or tag or by the number of hoses extending from the mattress.

The hoses, which include connectors, may be detachably connected to the control box 142 through a plurality of control box connectors 222 as illustrated in FIG. 1. While only six connectors are shown in FIG. 1, the current embodiment of the control box includes nine connectors, at least one of which is used when the foam mattress is coupled to the control box 142. It is within the scope of the present invention to have a core including both foam and air bladders. It is also within the scope of the present invention, to have automatic identification of the mattress by the control system. The control system may include a sensing device to sense an identifying tag coupled to the mattress.

Upon sensing the tag, the sensing device sends a signal to the controller indicating the type of identifying tag, and therefore the type of mattress.

Upon selection of the foam mattress assembly 80 at block 224, by pressing the menu button 210 corresponding to the word "FOAM" displayed on the display screen 146, the screen at block 226 is displayed on the display screen 146. Display screen at block 226 queries the user to select the deflation of side bolster mode. If the user selects "DEFLATE SIDE BOLSTER", then at block 228, the display screen provides for a selection of whether or not the user desires to deflate the side bolster. If the user selects "YES" at block 228, the screen at block 230 appears indicating that the side deflate function is active. If it is later determined that the user would like to inflate the side bolsters, the user would select the "INFLATE AND EXIT" selection at block 230 which causes the display of block 232 to be displayed asking whether or not it is desired to inflate the side bolsters. If "YES" is selected, the sides inflate as shown at block 233.

Figure 10:
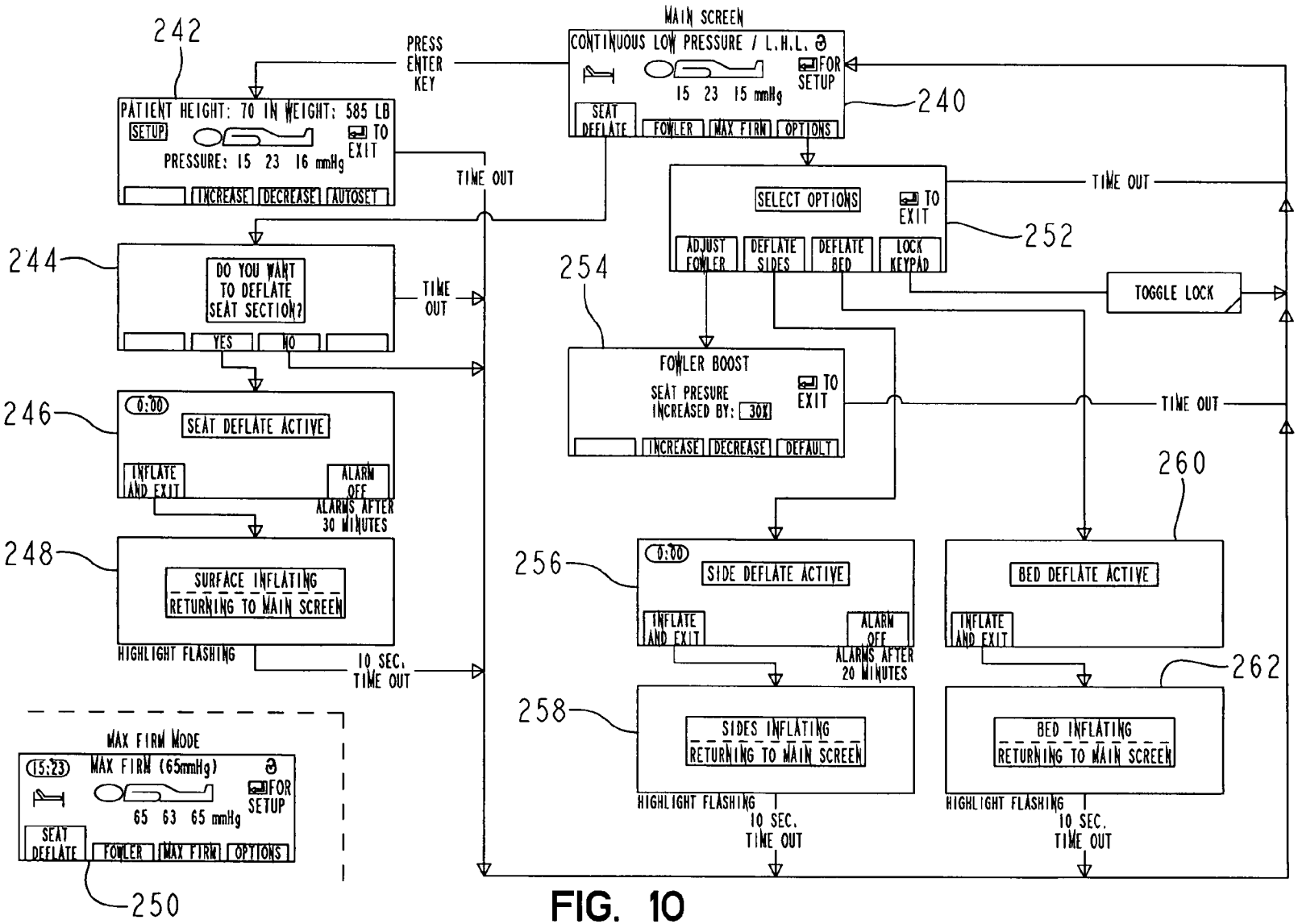
FIG. 10 is a flowchart illustrating a method of operating the mattress assembly of FIG. 2.

If, however, the user had selected the "AIR" selection at block 224 of FIG. 9, the display screen 146 provides the display shown at block 240 of FIG. 10. Block 240 indicates that the air mattress defaults to a continuous low pressure mode. The display provides for real time display of air pressures for inflated and deflated cells for each of the head, seat, and foot zones. In this mode, when the unit is first turned on, the seat zone pressure is automatically set to the "FOWLER" pressure where the standard pressure is increased by a certain percentage.

An initial pressure for each of the head, seat, and foot zones may be set by the control system according to the patient's height and/or weight. Entering the patient's height and weight into the control system causes the controller to establish an initial pressure for that particular patient for each zone. The "FOWLER" pressure is then determined based on the initial pressure for the seat zone. In the current embodiment, the selected "FOWLER" pressure is selected to be thirty percent above the initial seat pressure. It is within the scope of the present invention to use a different percentage as the amount to increase the initial seat pressure to achieve the "FOWLER" pressure. The "FOWLER" pressure is maintained at all times after the device is turned on, unless adjusted with the "FOWLER" button through the "OPTIONS" button described herein.

If the enter button 212 is depressed at block 240, the display screen 146 displays the information as illustrated in block 242. Block 242 provides selections for either increasing or decreasing the pressures in each of the zones by the selection of the arrow keys 210. This manual selection allows the user to adjust the pressure in each of the zones according to the requirements of the patient and/or the user. As can be seen, the pressure in each of the zones may be increased or decreased such that the patient can experience a desired comfort level. A "DEFAULT" mode button is provided to provide for automatically adjusting the pressures according to the height and weight of the patient which can be entered to the controller 147. The control system remains in this mode at block 242 until there is a time out at which time the screen at block 240 is displayed.

If the enter key is not depressed at block 240, but instead the "SEAT DEFLATE" key is depressed, the screen at block 244 is displayed. At this point, the user is given the option to select deflation of the seat section. If the user selects "YES" to deflate the seat section, then the screen at block 246 appears. During seat deflate, the controller 147 causes the air compressors 154 and 156 to operate in the vacuum mode and selects the vacuum air valve 202. A vacuum is applied to the first width extension 60 and the second width extension 62 through the A bolster valve 198 and the B bolster valve 200. The vacuum may be applied for a predetermined period of time, such as four minutes. In addition, the A-air valve 166 and the B-air valve 168 are opened to vent to atmosphere the A and B bladders 50 in the head section 180, the seat section 182, and the foot section 184. Seat deflate may be used to reduce the effort required by the patient to exit or to enter the bed. Seat deflate reduces the height of the seat portion of the mattress with respect to the floor and may also reduce the risk of the patient slipping off of the bed while getting on or off the bed. By vacuuming the air from the side bolsters, difficulties related to moving off of or moving onto the bed may be eliminated or reduced. Also, by venting the head, seat, and foot sections to atmosphere, the sections where the patient is seated or lying partially deflates due to patient weight. Consequently, some air remains in the bladders. Then, when it is desired to reinflate the mattress at block 248, quicker inflation results. The surface then inflates to the previously selected pressures so that the mattress returns to the last selected pressure profile.

In the illustrated embodiment during deflation, the vacuum is applied for approximately four minutes. An audible alarm is activated approximately 30 minutes after deflation is complete. This audible alarm remains on and reminds the user that the mattress is in the deflation mode, and that pressure relief is not provided to a patient lying on the mattress. The time periods for sounding the alarm may be preset in the system to any value or may be adjustable by the user.

Returning to block 240, if the "FOWLER" button is selected, the controller will increase the air pressure in the seat zone of the mattress assembly 40. The fowler seat boost may be used for patients resting in an inclined position to maintain some distance between the patient and the support deck to reduce or prevent bottoming out. Pressing the fowler button increases the pressure to 30% more than the seat section's set pressure.

Pressing the "MAX FIRM" selection at block 240 provides for the controller to illustrate the screen at block 250. The air pressure is increased within the assembly 40 to a predetermined maximum pressure to provide the patient with a firm surface, here illustrated as a surface having a pressure of 65 millimeters of mercury. Inflation of the mattress in the "MAX FIRM" mode provides the caregiver or health care provider a firm surface which may be necessary or preferred during the performing of certain procedures to the patients such as patient transfer or medical treatment. In the case of the bariatric patient, medical procedures are often performed on the bed itself, since patient size makes it problematic or difficult to move the patient from the bed to another surface for the procedure. After being in the "MAX FIRM" mode for a predetermined period of time, such as thirty minutes, the system does not return to a previously selected mode or setting. An alarm sounds indicating that the bed is still in the "MAX FIRM" mode at the end of the time period. The alarm may be silenced for a predetermined time period, such as fifteen minutes, by pressing an "ALARM OFF" button. The mattress remains in the "MAX FIRM" mode until the "MAX FIRM" mode button is pressed a second time, at which time the mattress returns to a previous mode.

Returning to block 240, if "OPTIONS" is selected, the controller 147 responding to the key selection displays the screen illustrated at block 252. The "SELECT OPTIONS SCREEN" includes the selections of "ADJUST FOWLER"

"DEFLATE SIDES", "DEFLATE BED", and "LOCK KEY PAD". If "ADJUST FOWLER" is selected at block 254, a user may either increase or decrease the fowler boost, which is shown as a percentage increased or decreased from a default pressure. If the user at block 252 instead selects to deflate the sides, the controller 147 causes the display to illustrate a side deflate active screen at block 256 in which the side bolsters are deflated as previously described by vacuuming the air from the bolsters. In this case, however, the bladders 50 are maintained at pressure.

The "DEFLATE SIDES" mode is used for moving a patient and/or the bed through the hospital where either the hallways, doorways, or elevator entrances are narrower than the width of the bed when the sliding panels are extended. In addition, this mode may be used to enable the caregiver to move closer to the patient when performing procedures. Once the side bolsters are deflated, the sliding panels 27 can be moved towards the center of the frame such that the frame width is reduced. If the sides remain deflated for a period of at least 20 minutes, an alarm sounds indicating that the sides are still deflated. It is possible to turn the alarm off with the "ALARM OFF" key as illustrated in block 256. If the alarm is turned off, the alarm will then sound after a 20 minute period of time. Once the patient and the bed have moved to a location where the sides can be reinflated, the user at block 256 selects the "INFLATE AND EXIT" selector. The screen at block 258 is then illustrated showing that the sides are inflating.

If the user at the "SELECT OPTIONS" screen 252 selects the "DELFATE BED" button, the bed will deflate as illustrated at block 260. The bed will remain deflated until the user selects the inflate and exit button in block 260 at which point the screen illustrated at block 262 is displayed.

Another option at block 252 is the "LOCK KEYPAD" selector button. Selecting this button locks various keys or buttons so that none of the various available features or mattress states can be selected.

Figure 11:
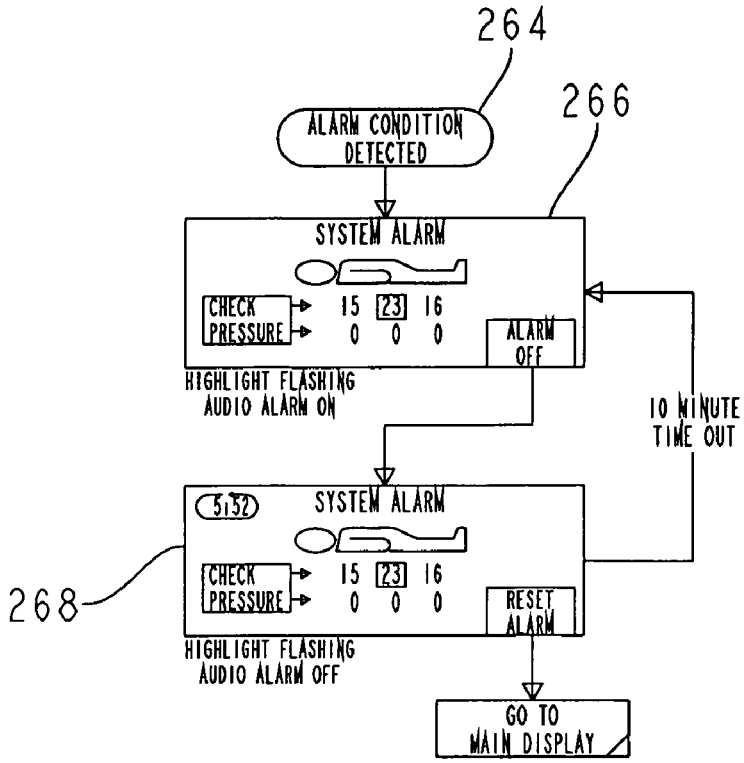
FIG. 11 is a flowchart illustrating a method of indicating a detected alarm condition.

FIG. 11 illustrates a state where the controller 147 detects an abnormal condition or fault condition at block 264. Under such abnormal conditions, an alarm is sounded and the display at block 266 is illustrated. Pressures for each of the zones (head, seat and foot) are illustrated in columns. The first line of illustrated pressures of each column are for the A bladders and the second line of illustrated pressures of each column are for the B bladders. The alarm can be turned off at block 266 by pushing "ALARM OFF". By pressing "ALARM OFF", the control system does not determine whether the fault condition has been corrected. In this mode, the alarm will sound again after a 10 minute period of time.

Once a user believes that the condition has been corrected, the user presses the "RESET ALARM" button. By pressing "RESET ALARM", the control system runs diagnostics to determine whether the fault condition has been corrected. Typically the diagnostic check takes longer than 10 minutes. If the fault condition has not been corrected, the alarm will sound again. If the fault condition has been corrected, the alarm should remain silent unless another fault condition is detected. The processor or controller then returns to the block 240.

Figure 12:
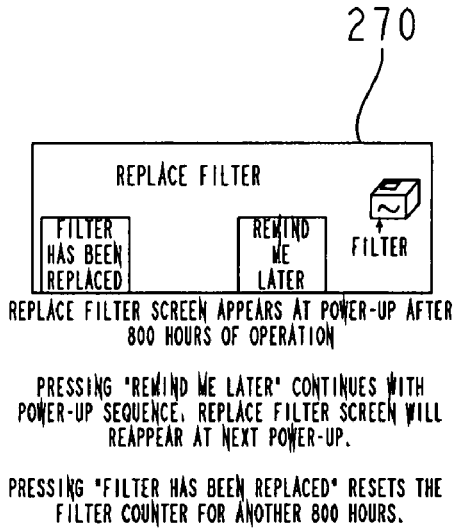
FIG. 12 is a flowchart illustrating a method of indicating a filter replacement condition.

FIG. 12 illustrates a replace filter reminder display on the display of the control panel after a predetermined period of operation. At block 270, the user may press "A FILTER HAS BEEN REPLACED" key indicating that the filter has been replaced or a "REMIND ME LATER" key requesting a reminder at a later time.

Although the invention has been described in detail with reference to certain preferred embodiments, variations and modifications exist within the scope and spirit of the present invention. For instance, other periods of time which are established to maintain the mattress within a certain mode are possible and are within the scope of the present disclosure.

What is claimed is:

1. A support surface system, comprising:

a core portion, to support a patient, the core portion including a first and a second side;

at least one width bladder, coupled to one of the first and second sides of the core portion;

a vacuum device, coupled to the at least the one width bladder, adapted to apply a vacuum to the at least one width bladder; and a control system, coupled to the vacuum device, adapted to inflate the at least one width bladder and to control the vacuum device to thereby apply a vacuum to the at least one width bladder, wherein the control system includes a processor and a memory including executable instructions, to cause the vacuum device to apply the vacuum to the at least one width bladder.

2. The support surface system of claim 1, wherein the core portion comprises a plurality of core bladders.

3. The support surface system of claim 2, wherein the plurality of core bladders comprise a first zone, to support a seat portion of the patient, and a second zone, to support an area other than the seat portion of the patient.

4. The support surface system of claim 3, further comprising a first zone valve coupled to the first zone, and a second zone valve coupled to the second zone, each of the first and second zone valves adapted to move between an open and closed position.

5. The support surface system of claim 4, wherein the processor is adapted to cause the first zone valve to move to the open position to thereby vent the first zone to atmosphere while the vacuum device applies a vacuum to the at least one width bladder.

6. The support surface system of claim 4, wherein the processor is adapted to cause the second zone valve to move to the open position thereby to vent the second zone to atmosphere while the vacuum device applies a vacuum to the at least one width bladder.

7. The support surface system of claim 3, wherein the second zone is adapted to support a head portion of the patient.

8. The support surface system of claim 3, wherein the plurality of core bladders further comprise a third zone, to support a foot portion of the patient.

9. The support surface system of claim 8, further comprising a third zone valve, coupled to the third zone.

10. The support surface system of claim 9, wherein the control system includes a processor and a memory including executable instructions, wherein the processor is adapted to access the memory to execute at least one executable instruction to cause the vacuum device to apply the vacuum to the at least one width bladder.

11. The support surface system of claim 10, wherein the processor executes at least one executable instruction to cause the vacuum to apply a vacuum to the at least one width bladder while the first, second, and third zone valves vent the corresponding first, second, and third zones to atmosphere.

12. The support surface system of claim 1, wherein the core portion comprises at least one core bladder.

13. The support surface system of claim 12, further comprising a blower adapted to inflate the at least one width bladder and the at least one core bladder.

14. The support surface system of claim 13, further comprising at least one core bladder valve coupled to the at least one core bladder and including a control line coupled to the processor, the at least one core bladder valve adapted to move between an open and a closed position.

15. The support surface system of claim 14, wherein the processor is adapted to move the at least one core bladder valve to the open position to thereby vent the core bladder to atmosphere while the vacuum device applies a vacuum to the at least one width bladder.

16. The support surface system of claim 6, wherein the processor is adapted to move the at least one core bladder valve to the open position to thereby vent the core bladder to atmosphere after the vacuum device applies a vacuum to the at least one width bladder.

17. The support surface system of claim 13, wherein the processor executes at least one executable instruction to inflate the at least one width bladder and the at least one core bladder to a firm condition resulting in a firm surface to enable a caregiver to perform a procedure on the patient while the patient remains on the surface.

18. The support surface system of claim 17, wherein the processor executes at least one instruction to inflate the at least one width bladder and the at least one core bladder to a pressure of at least 65 mm Hg for an extended period of time.

19. The support surface system of claim 17, further comprising an alarm coupled to the control system, wherein the processor executes at least one instruction to sound the alarm after the surface is in the firm condition for a predetermined period of time.

20. The support surface system of claim 19, wherein the alarm is adapted to be silenced after the predetermined period of time without reducing the pressure in the at least one width bladder and the at least one core bladder.

21. The support surface system of claim 1, wherein the core portion comprises foam.

22. A support surface system to support a patient, comprising:

a mattress, including a first zone to support a portion of the patient;

a user input device, including a user input to accept an indicator of patient size; and a control system, coupled to the user input device and to the mattress, the control system adapted to inflate the first zone to a first pressure according to the indicator of patient size and to a second pressure different than the first pressure, wherein the pressure in the first zone is automatically set to the second pressure when the control system is turned on.

23. The support surface system of claim 22, wherein the second pressure is greater than the first pressure.

24. The support surface system of claim 23, wherein the second pressure is selected to be an amount equal to the first pressure plus a predetermined percentage of the first pressure.

25. The support surface system of claim 24, wherein the predetermined percentage comprises approximately thirty percent.

26. The support surface system of claim 22, wherein the first zone is adapted to support a seat portion of the patient.

27. The support surface system of claim 22, further comprising an input device, coupled to the control system, the input device including a user input selectable to adjust the pressure within the first zone to a pressure other than the second pressure.

28. The support surface system of claim 22, wherein the pressure within the first the first zone remains at the second pressure unless adjusted with the user input.

29. The support surface system of claim 22, wherein the indicator of patient size is at least one of the patient's height and weight.

30. The support surface system of claim 22, wherein the indicator of patient size is a patient requirement.

31. The patient surface system of claim 22, wherein the patient is a bariatric patient.

32. A support surface system, comprising:

a core portion, including at least one core bladder, to support a patient, the core portion including a first and a second side;

at least one width bladder, coupled to one of the first and second sides of the core portion;

a vacuum device, coupled to the at least one width bladder, adapted to apply a vacuum to the at least one width bladder; and a control system, coupled to the vacuum device, adapted to control the vacuum device to thereby apply a vacuum to the at least one width bladder and adapted to inflate the at least one width bladder, the control system including a blower, adapted to inflate the at least one width bladder and the at least one core bladder and a processor and a memory including executable instructions, to cause the vacuum device to apply the vacuum to the at least one width bladder.

33. The support surface system of claim 32, further comprising at least one core bladder valve coupled to the at least one core bladder and including a control line coupled to the processor, the at least one core bladder valve adapted to move between an open and a closed position.

34. The support surface system of claim 33, wherein the processor is adapted to move the at least one core bladder valve to the open position to thereby vent the core bladder to atmosphere while the vacuum device applies a vacuum to the at least one width bladder.

35. The support surface system of claim 34, wherein the processor is adapted to move the at least one core bladder valve to the open position to thereby vent the core bladder to atmosphere after the vacuum device applies a vacuum to the at least one width bladder.

36. The support surface system of claim 32, wherein the processor executes at least one executable instruction to inflate the at least one width bladder and the at least one core bladder to a firm condition resulting in a firm surface to enable a caregiver to perform a procedure on the patient while the patient remains on the surface.

37. The support surface system of claim 36, further comprising an alarm coupled to the control system, wherein the processor executes at least one instruction to sound the alarm after the surface is in the firm condition for a predetermined period of time.

38. The support surface system of claim 37, wherein the alarm may be silenced after the predetermined period of time without reducing the pressure in the at least one width bladder and the at least one core bladder.

39. The support surface system of claim 38, wherein the processor executes at least one instruction to inflate the at least one width bladder and the at least one core bladder to a pressure of at least 65 mm Hg for an extended period of time.

40. A support surface system, comprising:

a core portion, including a plurality of core bladders, to support a patient, the core portion including a first and a second side, wherein the plurality of core bladders comprise a first zone, to support a seat portion of the patient, and a second zone, to support an area other than the seat portion of the patient;

at least one width bladder, coupled to one of the first and second sides of the core portion;

a vacuum device, coupled to the at least one width bladder, adapted to apply a vacuum to the at least one width bladder; and a control system, coupled to the vacuum device, adapted to control the vacuum device to thereby apply a vacuum to the at least one width bladder, wherein the control system is adapted to inflate the at least one width bladder, the control system including a processor and a memory including executable instructions, the processor being adapted to access the memory to execute at least one executable instruction to cause the vacuum device to apply the vacuum to the at least one width bladder; and a first zone valve coupled to the first zone, and a second zone valve coupled to the second zone, each of the first and second zone valves adapted to move between an open and a closed position.

41. The support surface system of claim 40, wherein the processor is adapted to cause the first zone valve to move to the open position to thereby vent the first zone to atmosphere while the vacuum device applies a vacuum to the at least one width bladder.

42. The support surface system of claim 40, wherein the processor is adapted to cause the second zone valve to move to the open position thereby to vent the second zone to atmosphere while the vacuum device applies a vacuum to the at least one width bladder.

43. A support surface system, comprising:

a core portion, including a plurality of core bladders, to support a patient, the core portion including a first and a second side, wherein the plurality of core bladders comprise a first zone, to support a seat portion of the patient, and a second zone, to support an area other than the seat portion of the patient, wherein the second zone is adapted to support a head portion of the patient;

at least one width bladder, coupled to one of the first and second sides of the core portion;

a vacuum device, coupled to the at least one width bladder, adapted to apply a vacuum to the at least one width bladder; and a control system, coupled to the vacuum device, adapted to control the vacuum device to thereby apply a vacuum to the at least one width bladder and adapted to inflate the at least one width bladder.

44. A support surface system, comprising:

a core portion, including a plurality of core bladders, to support a patient, the core portion including a first and a second side, wherein the plurality of core bladders comprise a first zone, to support a seat portion of the patient, a second zone, to support an area other than the seat portion of the patient, and a third zone to support a foot portion of the patient;

at least one width bladder, coupled to one of the first and second sides of the core portion, a vacuum device, coupled to the at least one width bladder, adapted to apply a vacuum to the at least one width bladder; and a control system, coupled to the vacuum device, adapted to control the vacuum device to thereby apply a vacuum to the at least one width bladder and adapted to inflate the at least one width bladder.

45. The support surface system of claim 44, further comprising a third zone valve, coupled to the third zone.

46. The support surface system of claim 45, wherein the control system includes a processor and a memory including executable instructions, wherein the processor is adapted to access the memory to execute at least one executable instruction to cause the vacuum device to apply the vacuum to the at least one width bladder.

47. The support surface system of claim 46, wherein the processor executes at least one executable instruction to cause the vacuum to apply a vacuum to the at least one width bladder while the first, second, and third zone valves vent the corresponding first, second, and third zones to atmosphere.

48. A support surface system, comprising:

a core portion, comprising foam, to support a patient, the core portion including a first and a second side;

at least one width bladder, coupled to one of the first and second sides of the core portion;

a vacuum device, coupled to the at least one width bladder, adapted to apply a vacuum to the at least one width bladder; and a control system, coupled to the vacuum device, adapted to control the vacuum device to thereby apply a vacuum to the at least one width bladder.

* * * * *